US011355832B2

(12) United States Patent
Deng et al.

(10) Patent No.: US 11,355,832 B2
(45) **Date of Patent: *Jun. 7, 2022**

(54) COMMUNICATIONS DEVICE

(71) Applicant: Huawei Technologies Co., Ltd., Shenzhen (CN)

(72) Inventors: Changshun Deng, Chengdu (CN); Chuan Liu, Chengdu (CN); Ke Long, Chengdu (CN); Shuchen Zhao, Chengdu (CN); Ji Yan, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 264 days.

This patent is subject to a terminal disclaimer.

(21) Appl. No.: 16/519,894

(22) Filed: Jul. 23, 2019

(65) Prior Publication Data

US 2020/0021013 A1 Jan. 16, 2020

Related U.S. Application Data

(63) Continuation of application No. 15/938,560, filed on Mar. 28, 2018, now Pat. No. 10,396,436, which is a (Continued)

(51) Int. Cl.
*H01Q 1/24* (2006.01)
*H01Q 1/48* (2006.01)

(Continued)

(52) U.S. Cl.
CPC ..... *H01Q 1/243* (2013.01); *H01Q 1/246* (2013.01); *H01Q 1/48* (2013.01); *H01Q 9/0421* (2013.01);

(Continued)

(58) Field of Classification Search
CPC ..... H01Q 1/243; H01Q 9/0471; H01Q 1/38; H01Q 9/30; H01Q 9/0421; H01Q 5/357; H01Q 9/40; H01Q 1/48; H01Q 9/0457
See application file for complete search history.

(56) References Cited

U.S. PATENT DOCUMENTS 5,420,596 A 5/1995 Burrell et al.
6,118,406 A * 9/2000 Josypenko ..... H01Q 1/38 343/700 MS (Continued)

FOREIGN PATENT DOCUMENTS

CN 2561108 Y 7/2003
CN 1484876 A 3/2004

(Continued)

OTHER PUBLICATIONS

Natarajan et al. "Effects of ground plane shape on performance of probe-fed, circularly polarized, pentagonal patch antenna", IEEE Antennas and Propagation Society International Symposium, vol. 2, pp. 720-723, Jan. 2003. (Year: 2003).*

(Continued)

*Primary Examiner* — Ricardo I Magallanes
(74) *Attorney, Agent, or Firm* — Slater Matsil, LLP

(57) ABSTRACT

A communications device is provided, including a metal carrier having a mounting plane with at least one mounting area, and further includes an antenna element disposed in each mounting area. The mounting area is where the mounting plane intersects a circle centered at a feedpoint of the antenna element in the area and whose radius does not exceed a specified radius. When a boundary line of the mounting area includes a boundary line, a distance from the feedpoint to the boundary line is less than or equal to a specified distance; and/or when a boundary line of the mounting area includes a vertex of the mounting plane, a distance from the feedpoint to the vertex is less than or equal to a specified distance. A feed position on the antenna element is designed to obtain relatively good antenna roundness performance and enhance an antenna signal coverage effect.

19 Claims, 14 Drawing Sheets

Related U.S. Application Data continuation of application No. PCT/CN2015/091057, filed on Sep. 29, 2015.

(51) Int. Cl.

| | |
|---|---|
| ***H01Q 9/04*** | (2006.01) |
| ***H01Q 19/00*** | (2006.01) |
| *H01Q 1/52* | (2006.01) |
| *H01Q 1/38* | (2006.01) |

(52) U.S. Cl.

CPC ..... *H01Q 9/0457* (2013.01); *H01Q 9/0471* (2013.01); *H01Q 19/005* (2013.01); *H01Q 1/38* (2013.01); *H01Q 1/528* (2013.01)

(56) References Cited

U.S. PATENT DOCUMENTS

| | | | | |
|---|---|---|---|---|
| 6,693,603 | B1 | 2/2004 | Smith et al. | |
| 7,450,082 | B1 * | 11/2008 | Lopez | H01Q 9/0421 343/844 |
| 9,680,210 | B2 | 6/2017 | Ella | |
| 2002/0019247 | A1 | 2/2002 | Egorov | |
| 2002/0093456 | A1 | 7/2002 | Sawamura et al. | |
| 2004/0087341 | A1 | 5/2004 | Edvardsson | |
| 2007/0120740 | A1 | 5/2007 | Iellici et al. | |
| 2010/0225542 | A1 | 9/2010 | Suzuki et al. | |

FOREIGN PATENT DOCUMENTS

| | | | |
|---|---|---|---|
| CN | 1894825 | A | 1/2007 |
| CN | 101286592 | A | 10/2008 |
| CN | 101826655 | A | 9/2010 |
| CN | 103825106 | A | 5/2014 |
| JP | H09232841 | A | 9/1997 |
| JP | H11330842 | A | 11/1999 |
| JP | 2002135028 | A | 5/2002 |
| JP | 2006261941 | A | 9/2006 |
| JP | 2007174462 | A | 7/2007 |
| JP | 2010245724 | A | 10/2010 |

OTHER PUBLICATIONS

Ciais, Pascal, et al,"Design of an Internal Quad.Band Antenna for Mobile Phones," IEEE Microwave and Wireless Components Letters, vol. 14, No. 4, Apr. 2004, 3 pages, XP011111539.

* cited by examiner

COMMUNICATIONS DEVICE

CROSS-REFERENCE TO RELATED APPLICATIONS

This application is a continuation of U.S. application Ser. No. 15/938,560, filed on Mar. 28, 2018, which is a continuation of International Application No. PCT/CN2015/091057, filed on Sep. 29, 2015. All of the afore-mentioned patent applications are hereby incorporated by reference in their entireties.

TECHNICAL FIELD

The present application relates to the field of communications technologies, and in particular, to a communications device.

BACKGROUND

An omnidirectional antenna is a type of antenna commonly used in an existing mobile communications device, and the omnidirectional antenna is widely applied to existing networks. In recent years, mobile communication develops towards high-order modulation, broadband, and multiple-input multiple-output technology (MIMO). The multiple-input multiple-output technology (MIMO) is an extremely important development direction. In the multiple-input multiple-output technology, a transmit end and a receive end use multiple transmit antennas and multiple receive antennas, so that signals are transmitted by using multiple antennas of the transmit end and the receive end. Therefore, the multiple-input multiple-output technology can exponentially increase a system capacity and improve spectral efficiency without increasing a spectrum resource. In the MIMO technology, an antenna technology is crucial, especially to a mobile communications device integrating an antenna. The following requirements pose a quite big challenge to antenna design: antenna miniaturization, broadbandization (standing wave broadbandization and pattern broadbandization), isolation between multiple antennas, and a correlation between multiple antennas.

Isolation between antennas and a correlation between antennas are crucial indicators for obtaining a high MIMO gain. A lower correlation between antennas indicates that a higher MIMO gain can be obtained. The isolation between antennas is an important indicator for obtaining a low correlation between antennas. However, because of a miniaturization requirement, it is a quite big challenge to obtain maximum isolation between antennas in a module having a given size.

In addition, a power balance between multiple antennas is also an extremely important aspect. In the multiple-input multiple-output technology, an excessively big power difference between multiple paths usually compromises a MIMO gain. A small tracking difference between patterns of multiple antennas is required for achieving the power balance, and for the omnidirectional antenna, this means that a good roundness (or non-roundness) indicator needs to be achieved. In an existing radio transceiver module integrating multiple antennas, for a purpose of module miniaturization, antenna elements of a PIFA or PILA type are usually selected. For a pattern of a PIFA or PILA, it is usually difficult to achieve a roundness as an independent omnidirectional antenna supporting SISO. This leads to a big tracking difference between patterns of multiple antennas, and affects MIMO performance to an extent.

In an existing common omnidirectional antenna, such as a monopole antenna or a discone antenna with wider bandwidth, a feedpoint and a radiator of the antenna are usually placed in central positions of a ground, and the radiator of the antenna is parallel with a normal line direction of the ground. This perfect rotational symmetry in terms of structure ensures a quite small horizontal fluctuation of a pattern of the antenna, so as to achieve an effect of even coverage.

All existing structures are designed based on a symmetrical structure. When a multi-antenna array is designed by using antenna elements designed based on the symmetrical structure, symmetry of an antenna radiation structure is maintained, but symmetry of the ground cannot be satisfied. This asymmetry usually causes current asymmetry on a carrier surface, and further leads to pattern distortion. A part of design can be maintained relatively good in a narrowband range, but it is quite difficult to achieve relatively wide bandwidth.

In addition, after an omnidirectional antenna element in the prior art is integrated on a carrier, a pattern of an antenna is extremely sensitive to a shape change of the carrier. For example, when the carrier is relatively thin (for example, 0.01 $\lambda$, where $\lambda$ is a wavelength corresponding to a minimum operating frequency of the antenna), a roundness of the pattern of the antenna can be ±2.5 dB. However, because the radio transceiver module includes multiple parts, such as a circuit board, a heat sink, and a shield cover, a thickness of a radio transceiver module integrating the antenna is usually greater than 0.01 $\lambda$. Therefore, when the antenna element in the prior art is integrated on such a module, the roundness of the pattern of the antenna may significantly deteriorate.

A pattern of an antenna located on a corner of the carrier has poor roundness performance because of deterioration of symmetry of a ground around the antenna. As shown in FIG. 1, FIG. 1 is a typical horizontal plane pattern of a broadband antenna that has a Patch-Slot-Pin (PSP) structure and that is mounted on a surface of a square prism carrier. It can be seen from FIG. 1 that depressions of different degrees exist in a shadow area of the figure, and the pattern has poor roundness performance.

SUMMARY

The present application provides a communications device, so as to improve roundness performance of an antenna of the communications device and further enhance an antenna signal coverage effect.

According to a first aspect, a communications device is provided, and the communications device includes: a metal carrier, where the metal carrier has a mounting plane, and at least one mounting area is defined on the mounting plane; and an antenna element disposed in each mounting area, where the antenna element includes: a radiation structure and a feed structure connected to the radiation structure, the feed structure is fastened to the mounting plane, and a point at which the feed structure is connected to the mounting plane is a feedpoint; where the mounting area is an area in which the mounting plane intersects a circle centered at the feedpoint of the antenna element in the mounting area and whose radius does not exceed a specified radius; when a boundary line of any of the mounting area includes a boundary line of the mounting plane, a distance from a feedpoint of an antenna element in the mounting area to the boundary line of the mounting area is less than or equal to a specified distance; and/or when a boundary line of the mounting area includes a vertex of the mounting plane, a distance from the feedpoint of the antenna element in the mounting area to the vertex is less than or equal to a specified distance.

With reference to the first aspect, in a first possible implementation, the specified distance is 0.12 $\lambda_l$, the specified radius is 0.25 $\lambda_l$, and $\lambda_l$ is a wavelength corresponding to a minimum operating frequency of the antenna element.

With reference to the first aspect or the first possible implementation of the first aspect, in a second possible implementation, a height of the antenna element is not greater than 0.25 $\lambda_l$.

With reference to any one of the first aspect, the first possible implementation of the first aspect, or the second possible implementation of the first aspect, in a third possible implementation, the vertex has a structure of a chamfer, and the distance from the feedpoint to the vertex is a distance from the feedpoint to a point at which a connection line between an intersection of extension lines of two boundary lines of the chamfer and the feedpoint intersects the chamfer.

With reference to any one of the first aspect, the first possible implementation of the first aspect, the second possible implementation of the first aspect, or the third possible implementation of the first aspect, in a fourth possible implementation, the metal carrier is a ground of the antenna element, a metal housing of a wireless device, or a circuit board or heat sink of a wireless device.

With reference to any one of the first aspect, the first possible implementation of the first aspect, the second possible implementation of the first aspect, the third possible implementation of the first aspect, or the fourth possible implementation of the first aspect, in a fifth possible implementation, the feed structure is a feed probe.

With reference to the fifth possible implementation of the first aspect, in a sixth possible implementation, the feed probe is a column structure, or the feed probe is a conductor sheet whose width gradually increases in a direction from the feedpoint to the radiation structure.

With reference to any one of the first aspect, the first possible implementation of the first aspect, the second possible implementation of the first aspect, the third possible implementation of the first aspect, the fourth possible implementation of the first aspect, the fifth possible implementation of the first aspect, or the sixth possible implementation of the first aspect, in a seventh possible implementation of the first aspect, the radiation structure includes at least one radiation patch.

With reference to the seventh possible implementation of the first aspect, in an eighth possible implementation, the radiation structure includes one radiation patch, and the radiation patch is an active radiation patch.

With reference to the seventh possible implementation of the first aspect, in a ninth possible implementation, the radiation structure includes two radiation patches, the two radiation patches are respectively a passive radiation patch and an active radiation patch, the active radiation patch is connected to the feed probe, the passive radiation patch is connected to a ground cable, and optionally, the active radiation patch and the passive radiation patch are connected by using at least one capacitance or inductance signal.

With reference to the ninth possible implementation of the first aspect, in a tenth possible implementation, the radiation structure further includes a dielectric plate or plastic support, the passive radiation patch and the active radiation patch are disposed on the dielectric plate or plastic support, or the dielectric plate or plastic support is a flat plate or a stepped plate, and when the dielectric plate or plastic support is a stepped plate, the passive radiation patch and the active radiation patch are respectively disposed on different step surfaces.

With reference to the tenth possible implementation of the first aspect, in an eleventh possible implementation, the dielectric plate or plastic support, the active radiation patch, and the passive radiation patch are an integrated printed circuit substrate structure.

According to the communications device provided in the first aspect, the metal carrier is considered as a part of an antenna body for joint design. The antenna element is arranged in a specific corner position on the metal carrier. A feedpoint position on the antenna element is designed to obtain relatively good antenna roundness performance and enhance an antenna signal coverage effect.

Figure 1:
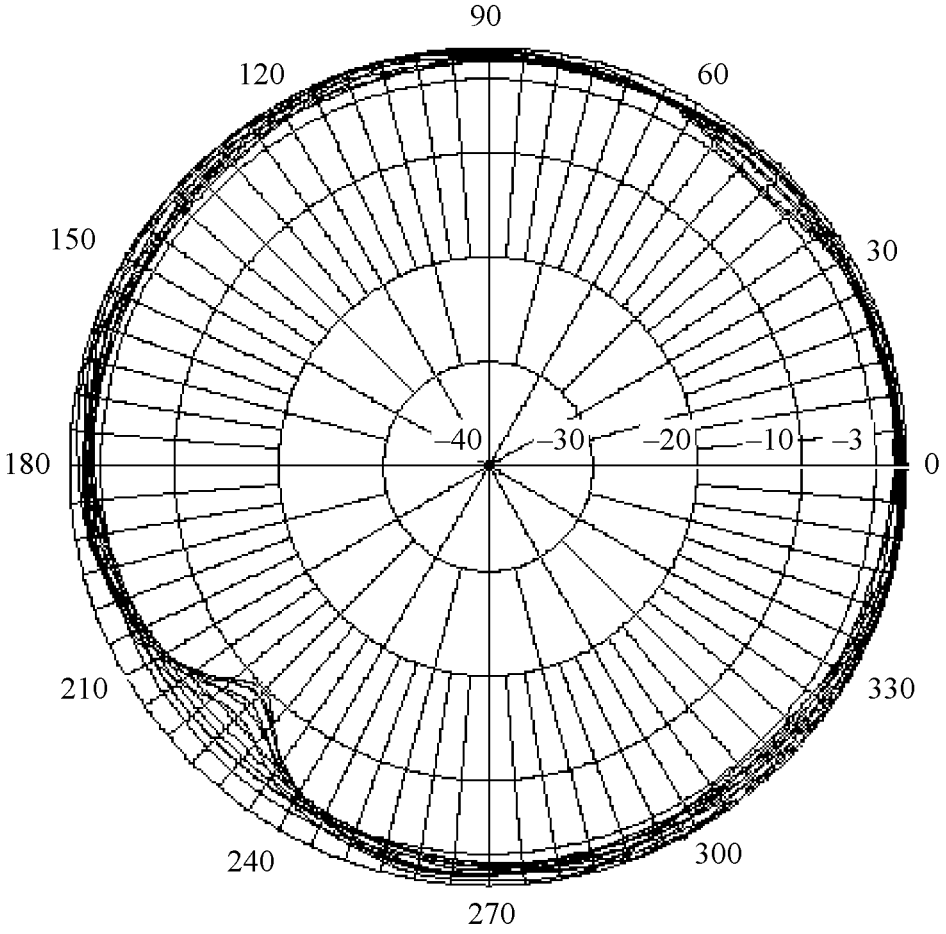
FIG. 1 is a typical horizontal plane pattern of a broadband antenna that has a PSP structure and that is mounted on a surface of a square prism carrier in the prior art.

Reference numerals: 1: Metal carrier; 11: Mounting plane; 2: Antenna element; 21: Radiation structure; 211: Active radiation patch; 212: Passive radiation patch; 213: Dielectric plate or plastic support; 22: Feed structure; and 23: Ground cable

DETAILED DESCRIPTION OF ILLUSTRATIVE EMBODIMENTS

The following describes the specific embodiments of the present application in detail with reference to accompanying drawings. It should be understood that the specific implementations described herein are merely used to explain the present application but are not intended to limit the present application.

Figure 2:
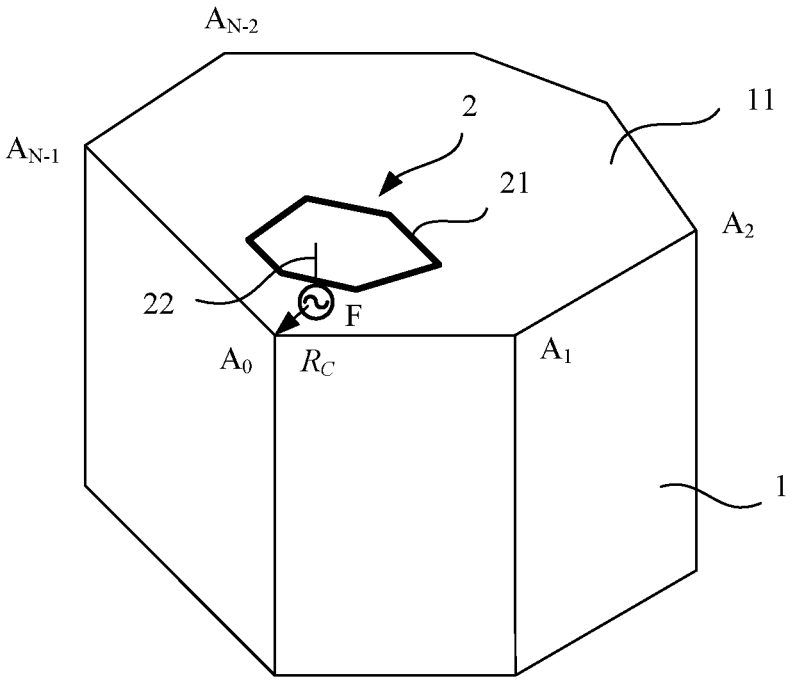
FIG. 2 is a schematic structural diagram of a communications device according to an embodiment of the present application.
Figure 6:
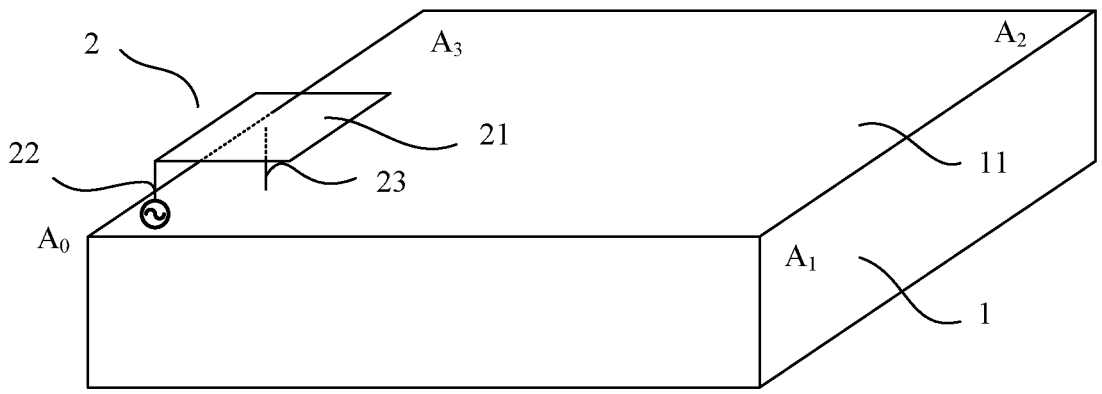
FIG. 6 is a schematic three-dimensional diagram of an antenna according to Embodiment 1 of the present application.

FIG. 2 and FIG. 6 show structures of communications devices with different structures provided in the embodiments of the present application.

An embodiment of the present application provides a communications device. The communications device includes a metal carrier 1, where the metal carrier 1 has a mounting plane 11, and at least one mounting area is defined on the mounting plane; and an antenna element 2 disposed in each mounting area, where each antenna element 2 includes: a radiation structure 21 and a feed structure 22 connected to the radiation structure 21, the feed structure 22 is fastened to the mounting plane 11, and a point at which the feed structure 22 is connected to the mounting plane 11 is a feedpoint; where the mounting area is an area in which the mounting plane intersects a circle centered at the feedpoint of the antenna element in the mounting area and whose radius does not exceed a specified radius; when a boundary line of any of the mounting area includes a boundary line of the mounting plane 11, a distance from a feedpoint of an antenna element 2 in the mounting area to the boundary line of the mounting area is less than or equal to a specified distance, and/or when the boundary line of the mounting area includes a vertex of the mounting plane, a distance from the feedpoint of the antenna element in the mounting area to the vertex is less than or equal to a specified distance.

In the foregoing embodiment, the metal carrier 1 is considered as a part of an antenna body for joint design. The antenna element 2 is arranged in a specific corner position on the metal carrier 1. A feed position on the antenna element 2 is designed to obtain relatively good antenna roundness performance and enhance an antenna signal coverage effect.

Optionally, the antenna element is fastened to the metal carrier by using a screw or glue. For a specific mounting or fastening manner, refer to the prior art. No limitation is imposed herein.

Specifically, most energy of an electronically small antenna (the electronically small antenna is usually an antenna whose maximum size is less than 0.25 times a wavelength) integrated on a metal carrier is radiated out by the carrier. The antenna can be considered as a coupler, and its function is coupling electromagnetic energy onto the carrier, so that the electromagnetic energy is radiated out by the carrier. In a conventional idea, to ensure symmetry of a pattern of the antenna, a ground structure (or carrier structure) of the antenna is designed as a symmetrical structure, and the antenna is placed in a symmetric center.

It can be found from research that the carrier of the antenna usually has some fixed characteristic modes, these characteristic modes are theoretically orthogonal, and an overall pattern of the antenna may be decomposed into a linear combination of these characteristic modes. When the antenna is placed in different positions, combinations of different characteristic modes are excited, and different patterns are further obtained. In the present application, based on this principle, the antenna is excited in an edge and/or a corner position of the carrier, and a pattern roundness is calculated, so as to obtain a relatively good roundness. For an electrically small antenna mounted on a metal carrier, energy is radiated out by an antenna body and the carrier. In some cases, carrier radiation accounts for 80% of total radiated energy. Therefore, not merely the antenna is excited. In some cases, the antenna is understood as a coupler that couples energy onto the carrier, so that the energy is radiated out by the carrier.

Figure 3:
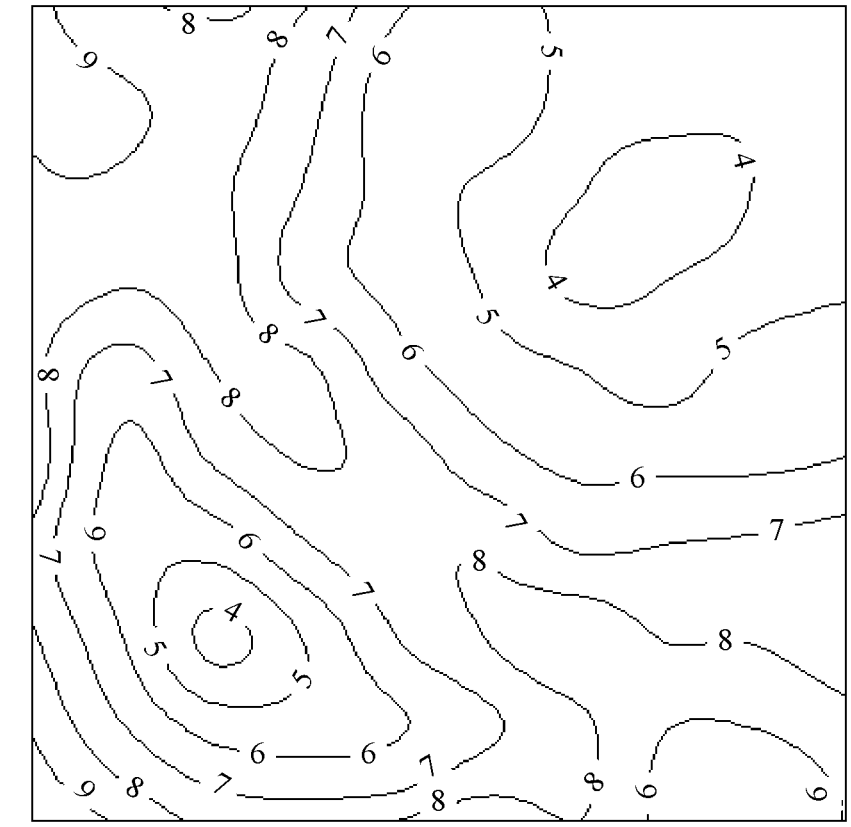
FIG. 3 is a contour map of antenna roundnesses in different feed positions on an edge and a corner of one plane of a cuboid carrier.

For example, FIG. 3 is a gradient map (similar to a geographical contour map) of pattern roundness in different antenna excitation positions around different vertexes A0 on one plane of a cuboid carrier. It can be clearly seen from FIG. 3 that an area (marked as 4, 5, and 6 in the figure) with an optimal roundness exists within a specific distance from a vertex A0. The communications device provided in the present application is designed based on the foregoing principle. Disposing position of an antenna element on a corner of the carrier is obtained, and the antenna is disposed in a vertex position of the carrier in the foregoing disposing manner, so that the antenna element in the vertex position of the carrier has relatively good roundness performance. In addition, when multiple antenna elements are disposed on the carrier, a distance between the antenna elements increases, and this leads to high isolation between the antenna elements.

In addition, when a feedpoint of the antenna is placed on a corner, a real part of radiation impedance of the antenna increases, and this is extremely beneficial to antenna miniaturization. A size of the antenna designed by using this method is usually smaller than a size of an antenna with same bandwidth in the prior art. Therefore, when more antennas are placed in a same area, a distance between the antennas can be longer, and isolation between the antennas can be effectively improved.

To facilitate understanding of the antenna provided in this embodiment of the present application, the following describes a structure of the antenna in detail with reference to a specific embodiment.

Specifically, the communications device provided in this embodiment may be a radio frequency module, such as an indoor remote radio unit RRU (remote radio unit), a base station, or another communications device equipped with an antenna. Optionally, in the communications device, an antenna and another module are integrated. The integration includes sharing a cover.

In this embodiment, a monopole antenna is used as an example for description. First, for several distances in the antenna provided in this embodiment, the distance from the feedpoint to the vertex or an edge (the boundary line of the mounting plane) of the mounting plane 11 is denoted as $R_C$, the radius of the circle drawn with the feedpoint as the center is denoted as $R_{ANT}$, and the height of the antenna element is denoted as H.

In this embodiment, as a specific embodiment, the metal carrier may be a right prism carrier, and the right prism carrier is a column structure with a top surface perpendicular to a side surface.

In addition, when each antenna element is specifically disposed, the antenna element may have a ground cable or may not have a ground cable. In this embodiment, the antenna element having a ground cable is used as an example for description.

When the antenna element 2 is specifically disposed, the following conditions may be met: When a boundary line of a bottom surface of an area occupied by any radiation structure 21 includes a boundary line of the mounting plane 11, a distance from the feedpoint to the boundary line of the mounting area is less than or equal to the specified distance, and/or when a boundary line of the bottom surface includes a vertex of the mounting plane 11, a distance from the feedpoint to the vertex is less than or equal to the specified distance. In addition, in specific disposing, a height of an antenna is a vertical distance from the radiation structure 21 to the mounting plane 11. Optionally, when the radiation structure 21 is specifically disposed, the height of the antenna is not greater than the set height in a specific application scenario. In an example, the specified distance is 0.12 $\lambda_l$, the specified radius is 0.25 $\lambda_l$, and the set height is 0.25 $\lambda_l$, where $\lambda_l$ is a wavelength corresponding to a minimum operating frequency of the antenna. In this way, an optimal roundness value is obtained for the antenna.

In this embodiment, different structures may be selected for the metal carrier 1 and the antenna. The metal carrier 1 may be a ground of the antenna, a metal housing of a wireless device, a circuit board, shield cover, or heat sink of a wireless device, or another structure. The metal carrier 1 may be in different shapes such as a polygonal column and a cylinder. One plane of the metal carrier 1 is the mounting plane 11 of the antenna. The mounting plane 11 may be in different shapes such as a polygon and a circle. When the metal carrier 1 is a polygonal column or a cylinder, the mounting plane 11 is correspondingly an end face of the metal carrier 1. In addition, when the metal carrier 1 is a polygonal column, the vertex of the mounting plane 11 has a structure of a chamfer, and the chamfer is a round angle structure or an oblique angle structure. In this case, the distance $R_C$ from the feedpoint to the vertex is a distance from the feedpoint to a position of a point at which a connection line between an intersection of extension lines of two boundary lines of the chamfer and the feedpoint intersects the chamfer.

Figure 4A:
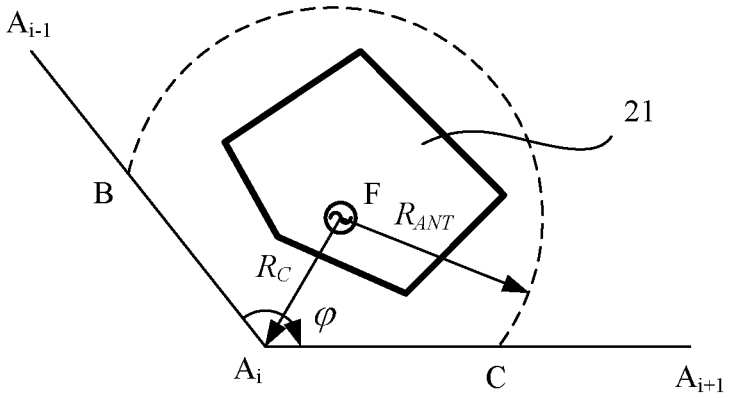
FIG. 4*a* to FIG. 4*f* are schematic diagrams of a bottom surface of an area occupied by a radiation structure according to embodiments of the present application.
Figure 4B:
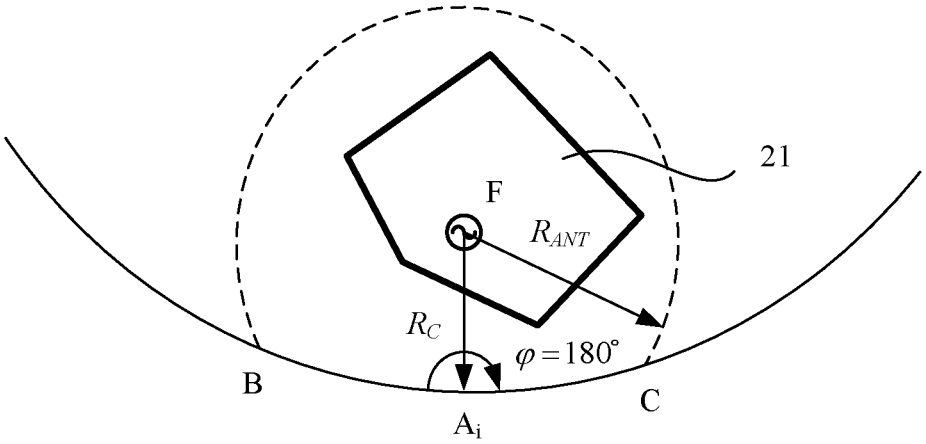
Figure 4C:
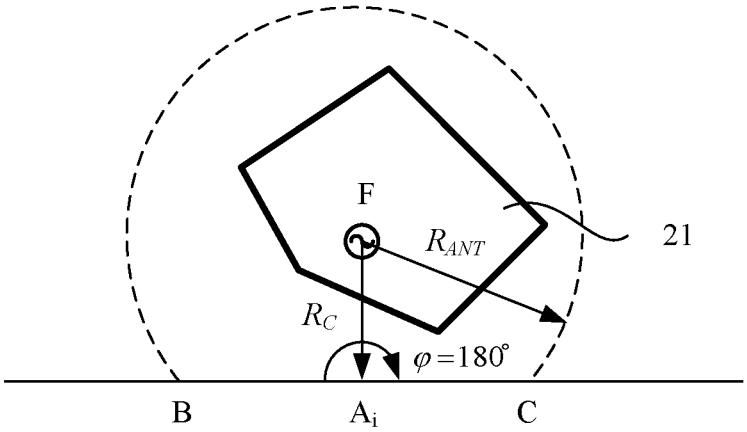
Figure 4D:
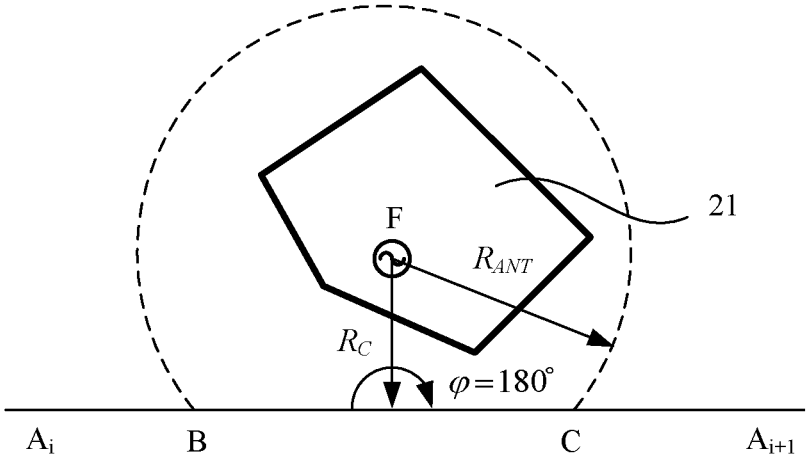
Figure 4E:
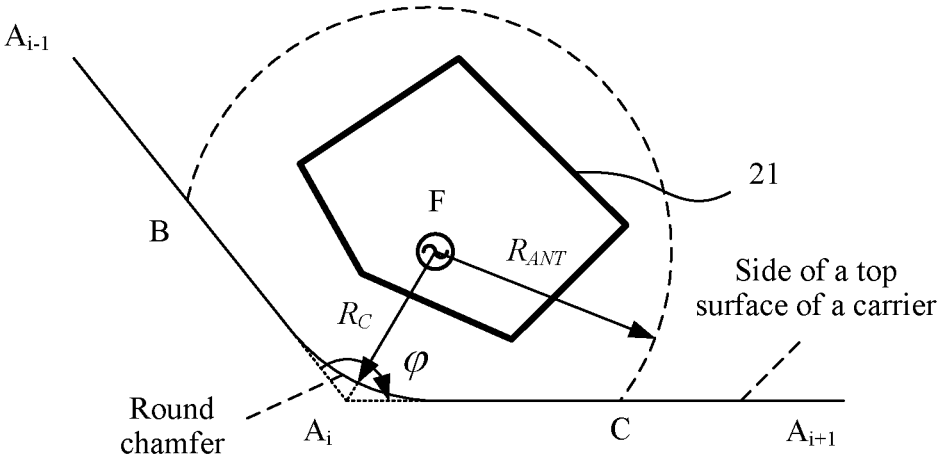
Figure 4F:
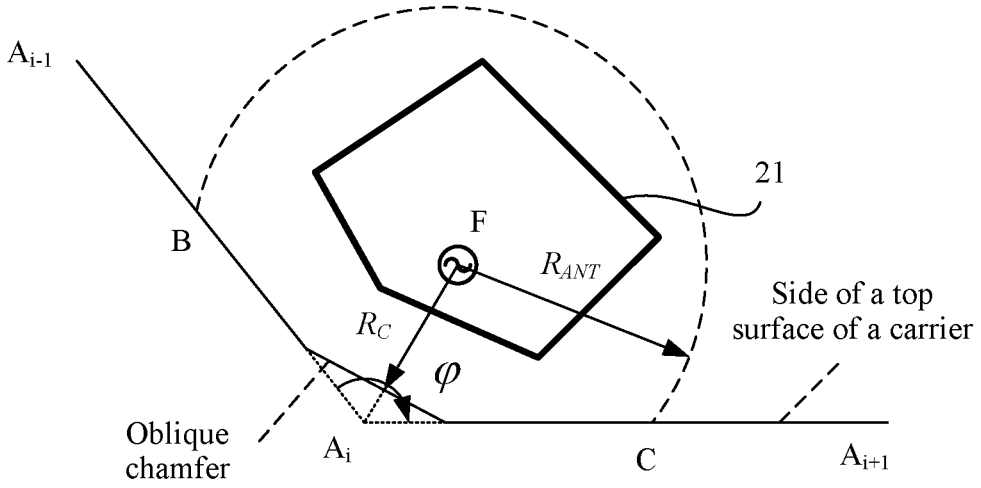

To facilitate understanding of $R_C$, refer to FIG. 4*a* to FIG. 4*f*. FIG. 4*a* to FIG. 4*f* show shapes of the bottom surface (mounting area) of the area occupied by the radiation structure 21 and specific distances $R_C$ when the mounting plane 11 are in different shapes. Referring first to FIG. 4*a*, the mounting plane 11 is polygonal, the vertex is $A_i$, two sides are respectively $A_{i-1}A_i$ and $A_iA_{i+1}$, and the feedpoint is F. In this case, the distance $R_C$ is a length of $FA_i$, and the mounting area is $BA_i$-$A_iC$-$\overset{\frown}{CB}$. As shown in FIG. 4*b*, the mounting plane 11 is circular, F is the feedpoint, $R_C$ is a minimum distance from the feedpoint to an are of the boundary line of the mounting plane 11, and the mounting area is $\overset{\frown}{CB}$-BC. As shown in FIG. 4*c*, the mounting plane 11 is $\overset{\frown}{CB}$ polygonal, F is the feedpoint, $R_C$ is a vertical distance from the feedpoint to the boundary line BC of the mounting plane 11, a perpendicular foot is $A_i$, and the mounting area is BC-$\overset{\frown}{CB}$. When the antenna is placed on a straight edge, φ(φ is a degree of an interior angle of a corner of the mounting plane 11) is equal to 180°, and this is a special case. As shown in FIG. 4*d*, the special case in which φ is equal to 180° is equivalent to a case in which the antenna element 2 is placed on an edge. As shown in FIG. 4*e*, a vertex shown in FIG. 4*e* has a round chamfer. Specifically, the mounting plane 11 is polygonal, the vertex is $A_i$, two sides are respectively $A_{i-1}A_i$ and $A_iA_{i+1}$, the vertex $A_i$ is an intersection of extension lines of the two sides, and the feedpoint is F. In this case, the distance $R_C$ is a length of $FA_i$, and the mounting area is $BA_i$-$A_iC$-$\overset{\frown}{CB}$. As shown in FIG. 4*f*, a vertex shown in FIG. 4*f* has an oblique chamfer. Specifically, the mounting plane 11 is polygonal, the vertex is $A_i$, two sides are respectively $A_{i-1}A_i$ and $A_iA_{i+1}$, the vertex $A_i$ is an intersection of extension lines of the two sides, and the feedpoint is F. In this case, the distance $R_C$ is a length of $FA_i$, and the mounting area is $BA_i$-$A_iC$-$\overset{\frown}{CB}$.

An antenna element 2 provided in this embodiment includes a radiation structure 21, a feed structure 22, and a ground cable 23. The feed structure 22 may be a feed probe. In specific disposing, the feed probe may be designed in different shapes. Optionally, the feed probe is a column structure, or the feed probe is a conductor sheet whose width gradually increases in a direction from a feedpoint to the radiation structure 21. In actual production, the feed probe may be designed in the foregoing shapes according to different requirements. It should be understood that the foregoing two structures are examples of specific structures and do not limit a structure of the feed probe. The feed probe may be designed, according to a requirement, in any other structural shape meeting the requirement.

Figure 13:
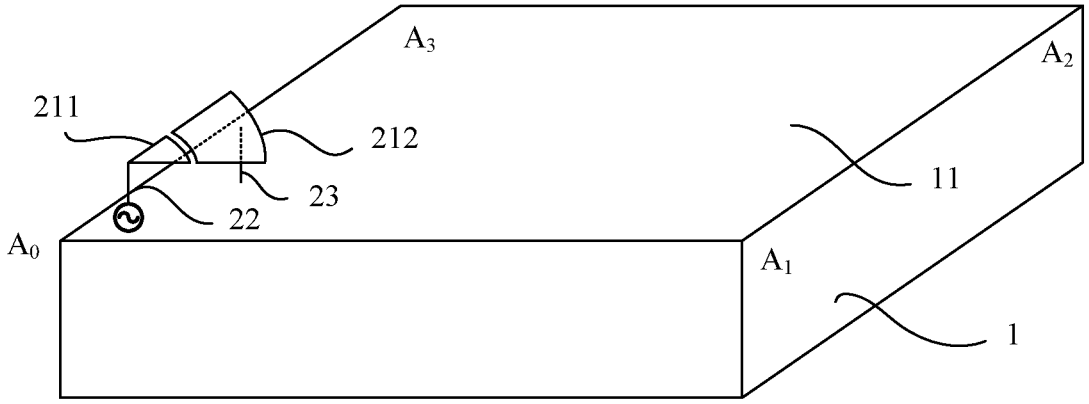
FIG. 13 is a three-dimensional diagram of an antenna according to Embodiment 3 of the present application.

Referring to FIG. 6 and FIG. 13, the radiation structure 21 may include at least one radiation patch. When the radiation structure 21 includes one radiation patch, the radiation patch is an active radiation patch 211. When multiple radiation patches are used, the radiation patches may be an active radiation patch 211 and a passive radiation patch 212 (the active radiation patch 211 and the passive radiation patch 212 are structures that are structurally distinguished from each other, the active radiation patch is a portion structurally connected directly to a radio frequency transmission line, and the passive radiation patch 212 is a portion that is structurally spaced a distance apart from the active radiation patch 211 and is not directly connected to the radio frequency transmission line). For example, the radiation structure 21 includes two radiation patches, the two radiation patches are respectively the passive radiation patch 212 and the active radiation patch 211, the active radiation patch 211 is connected to the feed probe, and the passive radiation patch 212 is connected to the ground cable 23. Optionally, the active radiation patch 211 and the passive radiation patch 212 are connected by using at least one capacitance or inductance signal. When multiple radiation patches are used, the radiation structure 21 may further include a dielectric plate or plastic support 213, and the passive radiation patch 212 and the active radiation patch 211 are disposed on the dielectric plate or plastic support 213. Therefore, an integrated structure is formed for the radiation structure 21. In a specific design, the dielectric plate or plastic support 213 may be a flat plate or a stepped plate. When the dielectric plate or plastic support 213 is a stepped plate, the passive radiation patch 212 and the active radiation patch 211 are respectively disposed on different step surfaces 213*s* as illustrated in FIG. 14B. In addition, the radiation patches and the dielectric plate or plastic support 213 may be designed to be a split type or an integrated type. When the split type is used, the dielectric plate or plastic support 213 may be a plastic plate. When the integrated type is used, the dielectric plate or plastic support 213, the active radiation patch 211, and the passive radiation patch 212 are an integrated printed circuit substrate structure. This facilitates design and production of the radiation structure 21. It can be understood that the foregoing active radiation patch may also be designed in a stepped shape, and details are not described herein.

In addition, in specific design, a radiation patch may be in different shapes, for example, a polygonal shape or a fan shape. When the radiation patch is in a polygonal shape, the radiation patch may be in a rectangular shape, a pentagonal shape, or a different shape.

Figure 5:
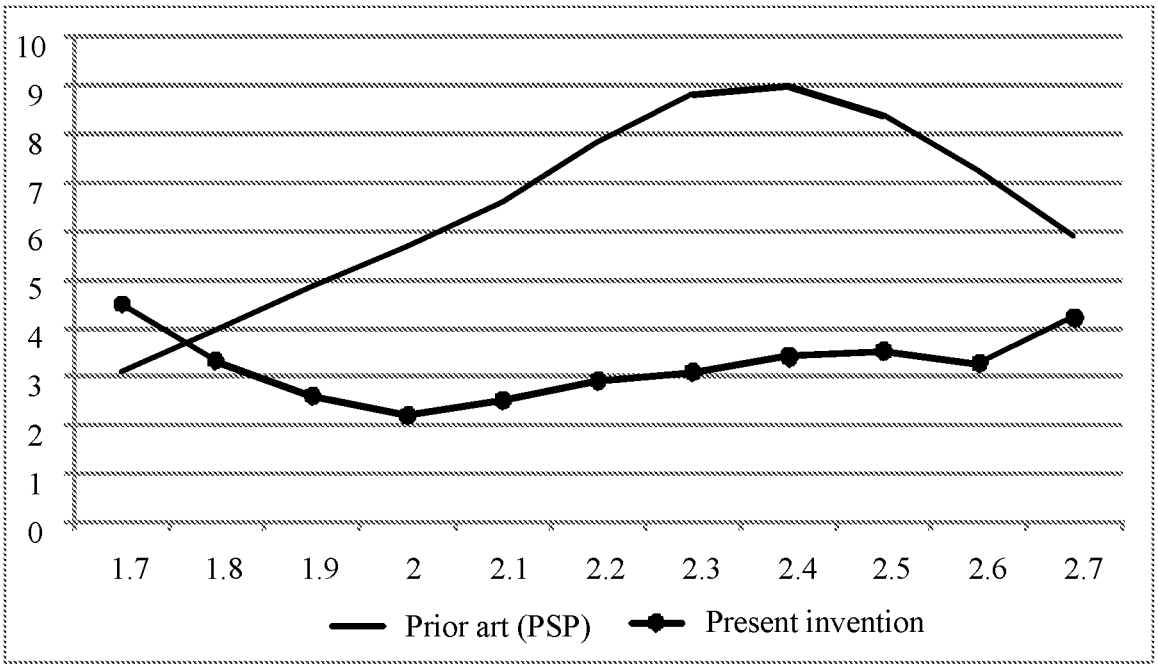
FIG. 5 is a diagram of roundness comparison between an antenna according to an embodiment of the present application and an antenna in the prior art.

In this embodiment, optionally, the radiation structure 21 used in the antenna is an asymmetric structure relative to the feedpoint. When the antenna is arranged on a corner of the mounting plane 11, $R_C$ can meet a requirement. Specifically, the requirement is that $R_C$ is less than a specified distance, the specified distance is 0.12 $\lambda_l$, and $\lambda_l$ is a wavelength corresponding to a minimum operating frequency of the antenna. When the feedpoint of the antenna is placed in a position close to the corner, the antenna can maintain good roundness performance. When the distance $R_C$ from the feedpoint to the vertex is less than 0.12 $\lambda_l$, a roundness of the antenna is optimal. As shown in FIG. 5, FIG. 5 shows comparison between a roundness value of the antenna provided in this embodiment and that of an antenna in the prior art. A horizontal coordinate indicates a frequency in a unit of GHz, and a vertical coordinate indicates a roundness in a unit of dB. It can be seen from FIG. 5 that the roundness value of the antenna provided in this embodiment is much better than that of the antenna in the prior art. Optionally, the radiation structure 21 used in the antenna may be a symmetrical structure relative to the feedpoint, and details are not described herein.

The following describes structures of the antenna provided in the embodiments of the present application in detail with reference to specific accompanying drawings. In the following specific embodiments, different values of the distance Re from the feedpoint to the vertex or boundary line of the mounting surface are given for emulation, and specific structural parameters used during mounting of the antenna element are given. The structural parameters may be designed according to an actual situation. The following embodiments are merely emulation descriptions by using a specific structure of a specific antenna as an example.

Embodiment 1

Figure 7:
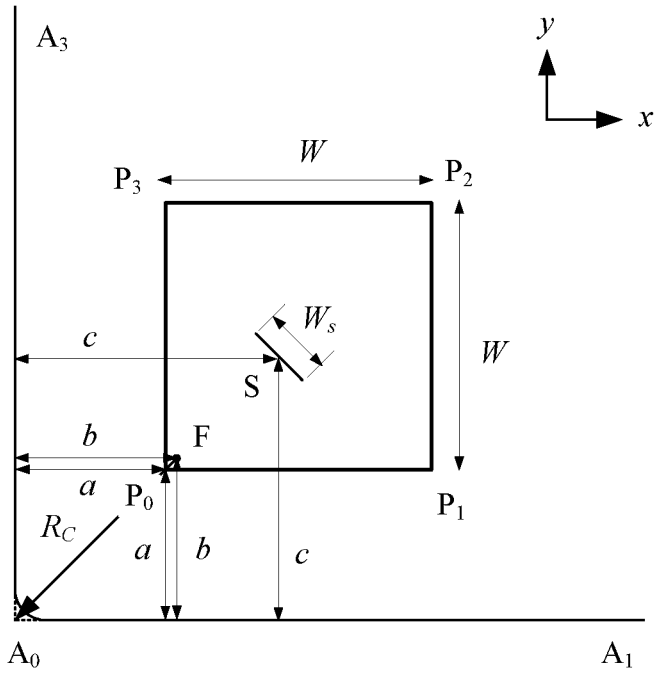
FIG. 7 is a top view of the antenna according to Embodiment 1 of the present application.
Figure 8:
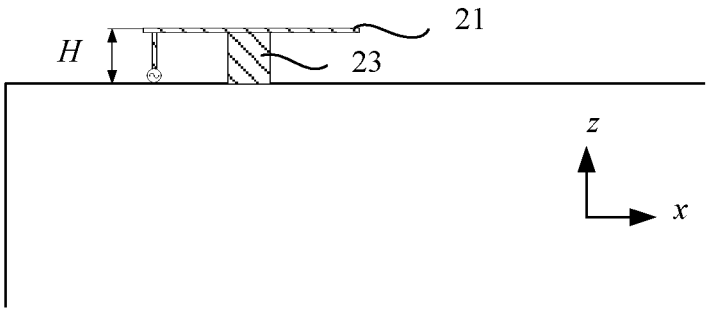
FIG. 8 is a side view of an antenna according to an embodiment of the present application.
Figure 9:
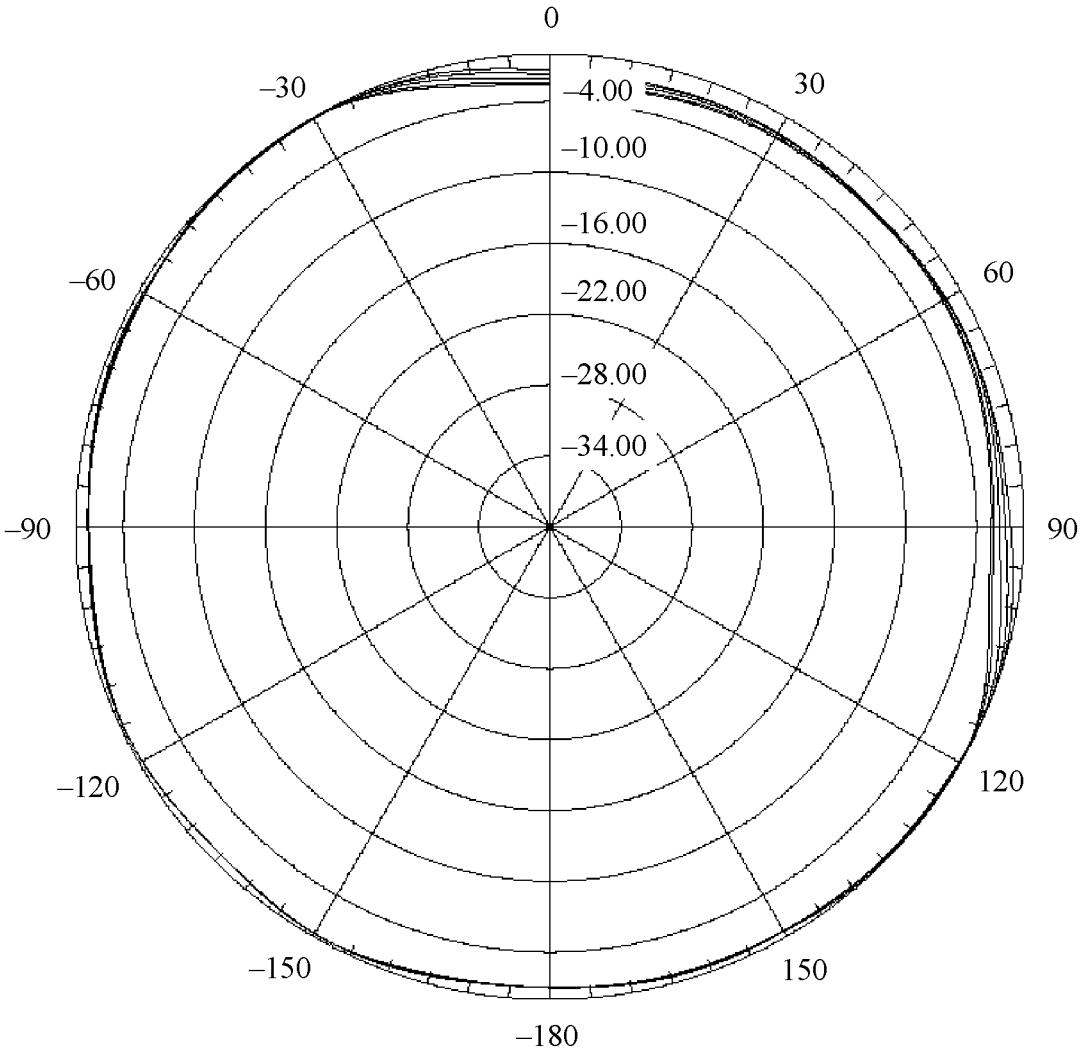
FIG. 9 is a roundness diagram of an antenna according to an embodiment of the present application.

Referring to FIG. 6 to FIG. 9, FIG. 6 is a schematic three-dimensional diagram of a communications device in this embodiment, FIG. 7 is a top view of the antenna provided in this embodiment, FIG. 8 is a side view of the antenna provided in this embodiment, and FIG. 9 is a roundness diagram of the antenna provided in this embodiment.

As shown in FIG. 6, the antenna in this embodiment of the present application includes one cuboid metal carrier 1 and one antenna element 2 that is designed according to the foregoing principle. The antenna element 2 is mounted on a metal plane of the metal carrier 1, and the metal plane is a mounting surface 11. The metal carrier 1 may be a structure in different shapes, for example, a polygonal column or a cylinder. In this embodiment, the metal carrier 1 is a cuboid, the antenna element 2 includes a feed probe, an active radiation patch 211, and one or more ground cables 23, and the active radiation patch 211 is in any shape. The active radiation patch 211 and the metal plane (the mounting surface 11) are connected by using the ground cable 23.

When the radiation patch is in a square shape, a good match and a good pattern may be obtained in an operating frequency band by adjusting a size of the antenna.

As shown in Table 1, FIG. 7, and FIG. 8, Table 1 below lists key structural parameters in Embodiment 1 ($\lambda_l$ is a wavelength corresponding to a minimum operating frequency):

| Structural Parameter | Structural Parameter Description | Electrical length ($\lambda_1$) |
|---|---|---|
| a | Distances from a side P0-P1 of a square patch P0-P1-P2-P3 to a side A0-A1 of a mounting plane and from a side P0-P3 of the square patch to a side A0-A3 of the mounting plane in an X-Y plane | 0.046 |
| b | Distances from a feedpoint F to the side A0-A1 and to the side A0-A3 of the mounting plane in the X-Y plane | 0.051 |
| c | Distances from a shorting pin to the side A0-A1 and to the side A0-A3 of the mounting plane in the X-Y plane | 0.090 |
| Ws | Width of the shorting pin | 0.015 |
| W | Side length of the square patch P0-P1-P2-P3 | 0.138 |
| H | Distance from the square patch P0-P1-P2-P3 to the mounting plane A0-A1-A2-A3 in a Z direction | 0.057 |
| Rc | Distance from the feedpoint F to a vertex A0 of the carrier plane in the X-Y plane | 0.073 |

Referring to FIG. 9, FIG. 9 shows a pattern roundness of the antenna element that is disposed according to the structural parameters in Table 1 and operates at frequencies in Table 2.

Table 2 is as follows:

| Frequency GHz | Roundness (Theta = 80 deg, where theta indicates a theta axis of a spherical coordinate system, and deg is a unit, that is, degree) dB |
|---|---|
| 1.71 | 1.8 |
| 1.76 | 1.8 |
| 1.81 | 2.1 |
| 1.86 | 2.5 |
| 1.88 | 2.8 |

Embodiment 2

Figure 10:
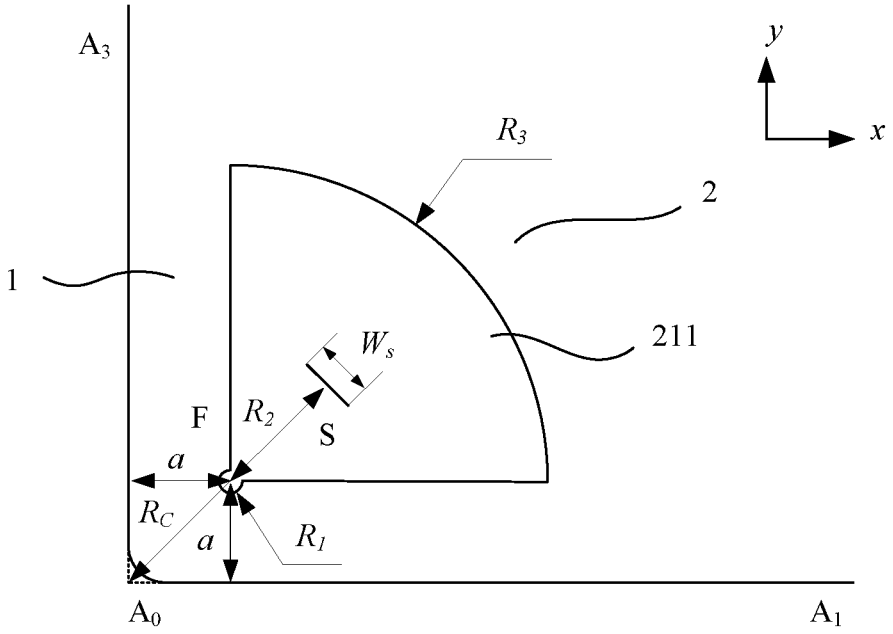
FIG. 10 is a top view of an antenna according to Embodiment 2 of the present application.
Figure 11:
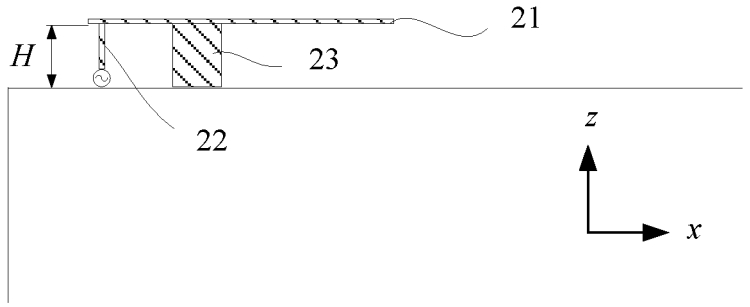
FIG. 11 is a side view of the antenna according to Embodiment 2 of the present application.
Figure 12:
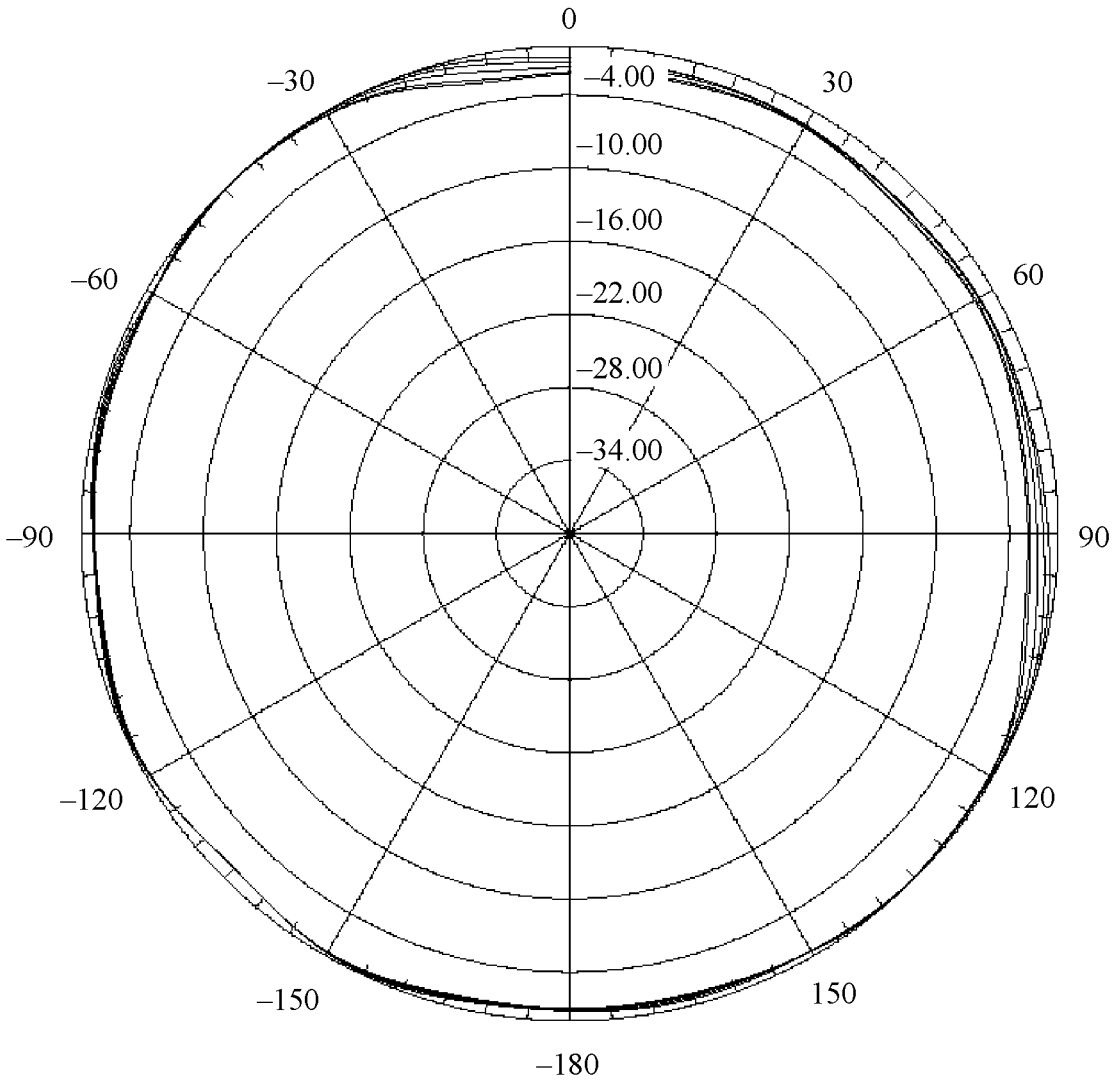
FIG. 12 is a roundness diagram of the antenna according to Embodiment 2 of the present application.

Referring to FIG. 10 to FIG. 12, FIG. 10 is a top view of a communications device in this embodiment, FIG. 11 is a side view of the antenna provided in this embodiment, and FIG. 12 is a roundness diagram of the antenna provided in this embodiment.

Referring first to FIG. 10 and FIG. 11, the antenna in this embodiment includes one cuboid metal carrier 1 and one antenna element 2 that is designed according to the foregoing principle. The antenna element 2 is mounted on a metal plane of the metal carrier 1. Further, the metal carrier 1 is a cuboid, and the antenna element 2 includes a feed probe, an active radiation patch 211, and one or more ground cables 23. The active radiation patch is in any shape, for example, the patch is designed in a fan shape in this embodiment.

When the patch is in a circular shape, a good match and a good pattern may be obtained in an operating frequency band by adjusting a size of the antenna.

Referring to Table 3, Table 3 below lists key structural parameters in Embodiment 2 ($\lambda_l$ is a wavelength corresponding to a minimum operating frequency):

| Structural Parameter | Structural Parameter Description | Electrical Length ($\lambda_1$) |
|---|---|---|
| a | Distances from a feedpoint center F to a side A0-A1 and to a side A0-A3 of the mounting plane in an X-Y plane | 0.0456 |
| R1 | Radius of the feed probe | 0.0057 |
| R2 | Distance from the feedpoint center F to a shorting pin center S | 0.0684 |
| R3 | Radius of the radiation patch | 0.16188 |
| Ws | Width of the shorting pin | 0.01539 |
| Rc | Distance from the feedpoint center F to a vertex A0 of the mounting plane in the X-Y plane | 0.064488138 |
| H | Distance from the radiation patch to a carrier plane | 0.057 |

Referring to FIG. 12, FIG. 12 shows a pattern roundness of the antenna element 2 that is disposed according to the structural parameters in Table 3 and operates at powers in Table 4.

Table 4 is as follows:

| Frequency GHz | Roundness (Theta = 80 deg) dB |
|---|---|
| 1.71 | 1.6 |
| 1.76 | 1.6 |
| 1.81 | 1.8 |
| 1.86 | 2.3 |
| 1.88 | 2.5 |

Embodiment 3

Figure 14:
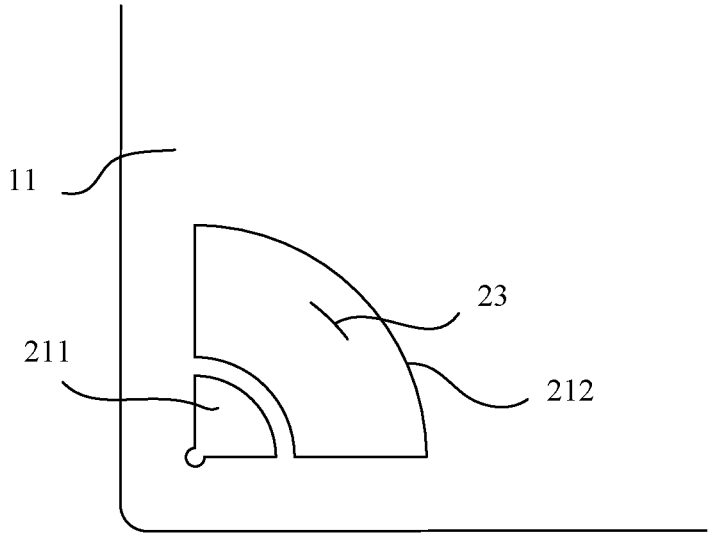
FIG. 14 is a top view of the antenna according to Embodiment 3 of the present application.
Figure 14B:
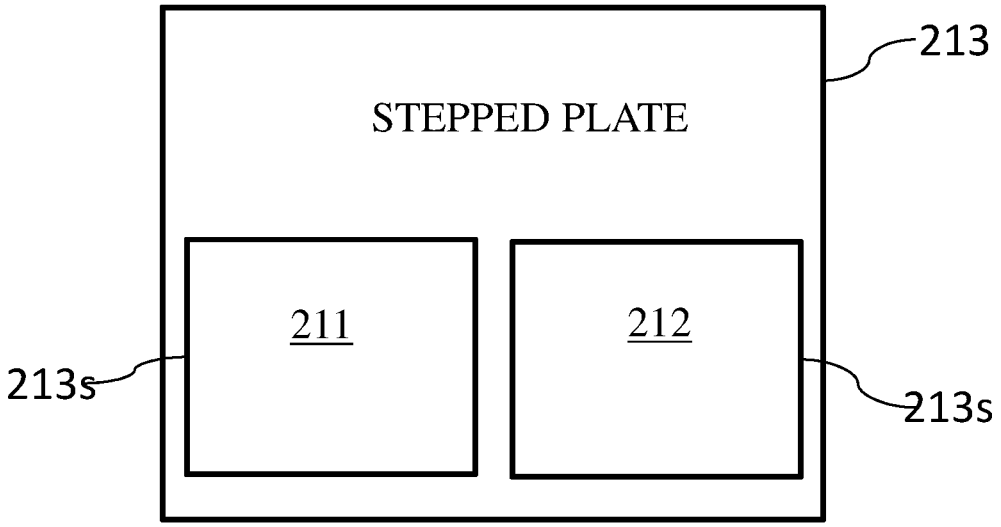
FIG. 14B illustrates a specific design when the dielectric plate or plastic support 213 is a stepped plate.
Figure 15:
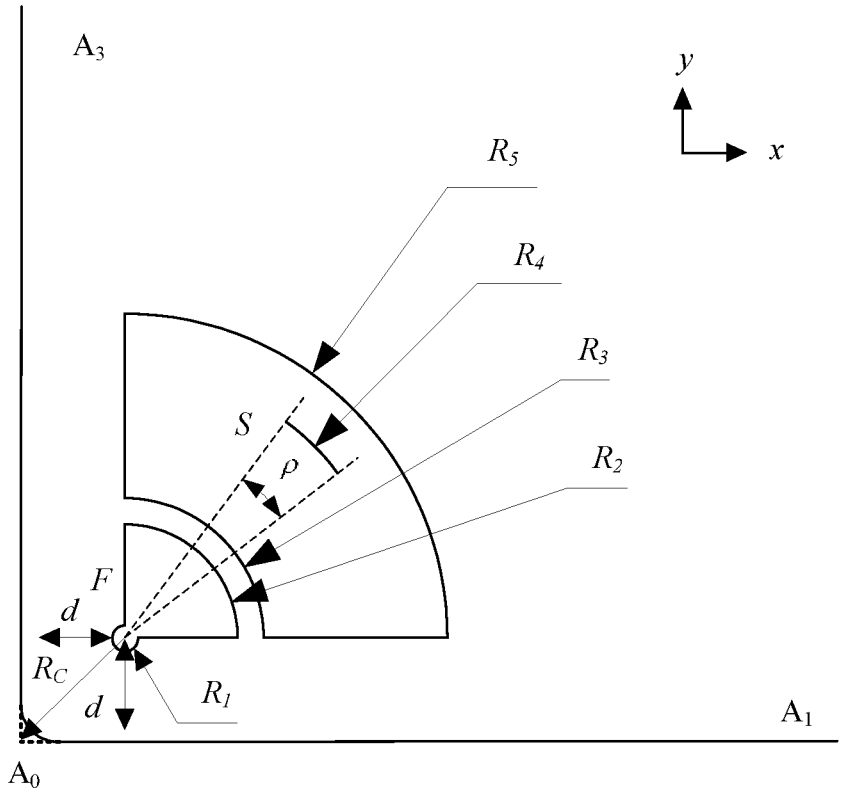
FIG. 15 is a schematic diagram of structural parameters of the antenna according to Embodiment 3 of the present application.
Figure 16:
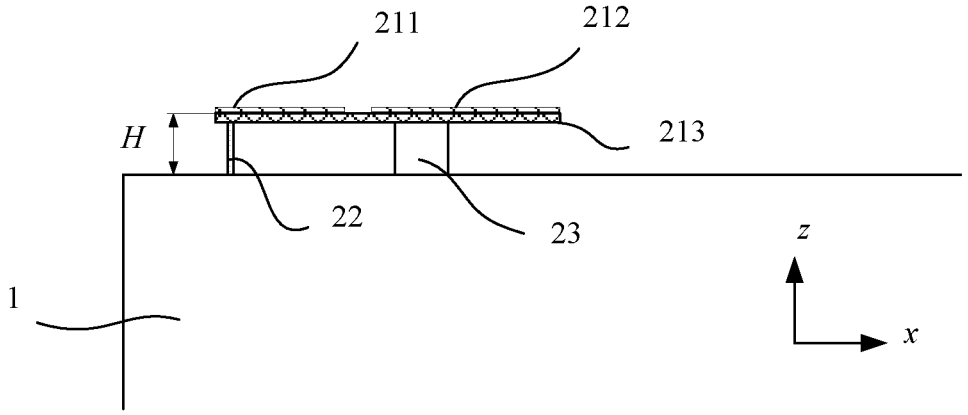
FIG. 16 is a side view of the antenna according to Embodiment 3 of the present application.
Figure 17:
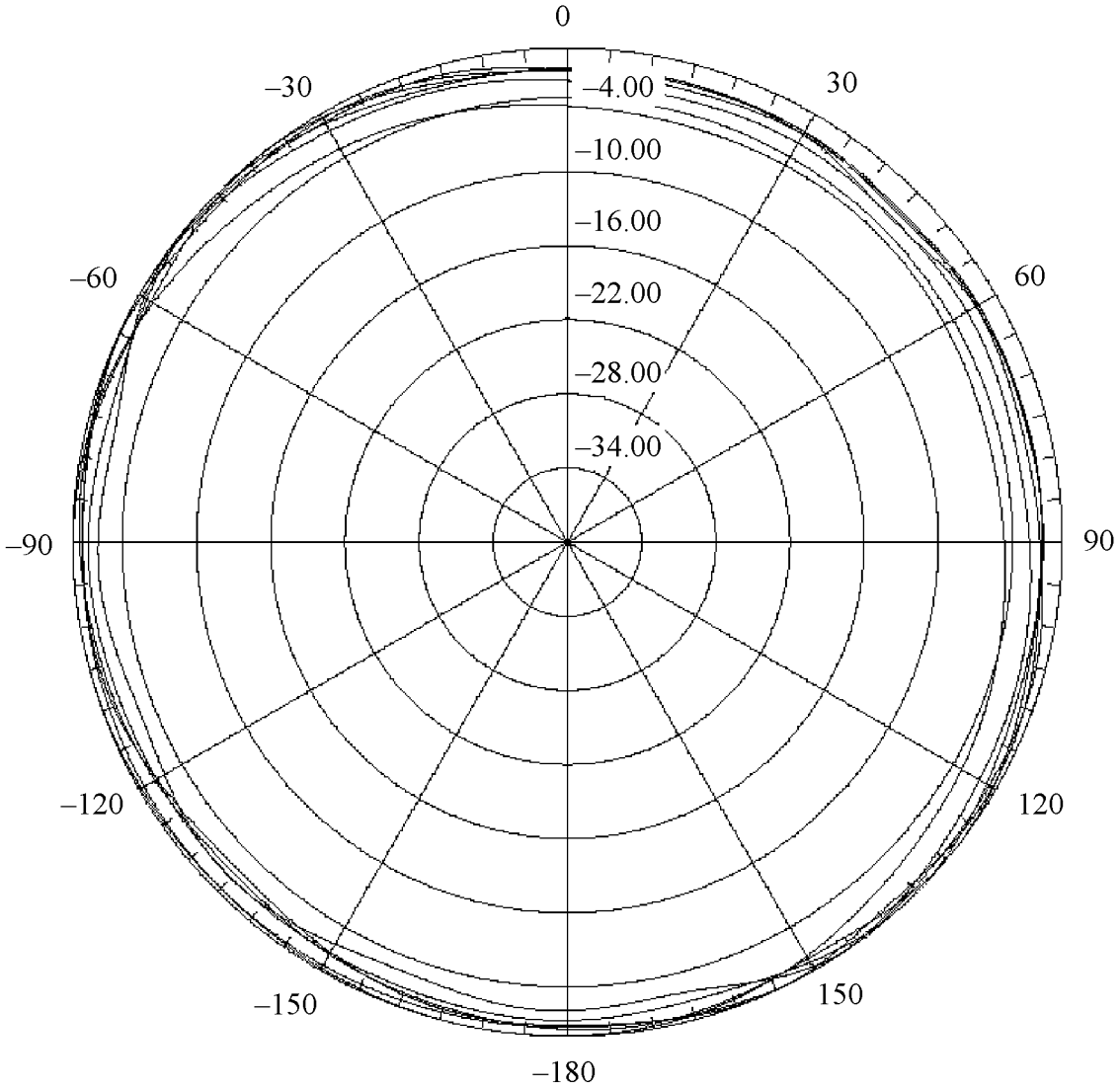
FIG. 17 is a roundness diagram of the antenna according to Embodiment 3 of the present application.

Referring to FIG. 13 to FIG. 17, FIG. 13 is a three-dimensional diagram of a communications device in this embodiment, FIG. 14 is a top view of the antenna provided in this embodiment, FIG. 15 is a schematic diagram of structural parameters of the antenna provided in this embodiment, FIG. 16 is a side view of the antenna provided in this embodiment, and FIG. 17 is a roundness diagram of the antenna provided in this embodiment.

As shown in FIG. 13, the antenna in this embodiment includes one cuboid metal carrier 1 and one antenna element 2 that is designed according to the foregoing principle. The antenna element 2 is mounted on a metal plane of the metal carrier 1. Further, the metal carrier 1 is a cuboid, and the antenna element 2 includes a feed probe, one active radiation patch 211, and one passive radiation patch 212. Further, the passive radiation patch 212 and a ground plane are connected by using one or more ground cables 23. The radiation patches are in any shape, for example, a square shape or a fan shape. The fan shape is used as an example in this embodiment.

Further, the active radiation patch 211 and the passive radiation patch 212 are supported by using a plastic plate, or the active radiation patch 211, the passive radiation patch 212, and a dielectric plate or plastic support 213 are manufactured by using one microstrip board.

Standing wave bandwidth (VSWR<2.5, where VSWR<2.5 is a method for calculating the standing wave bandwidth, and indicates bandwidth meeting a condition that VSWR<2.5) exceeding 45% may be achieved by adjusting the structural parameters of the antenna. In addition, a pattern roundness of the antenna maintains good performance in the bandwidth.

Specifically, referring to FIG. 15, FIG. 16, and Table 5, Table 5 lists specific values of the structural parameters shown in FIG. 15. Table 5 is as follows:

| Structural Parameter | Structural Parameter Description | Value |
|---|---|---|
| H | Distance from a fan radiation patch to a mounting plane of the carrier | 0.057 $\lambda_1$ |
| d | Distances from a feedpoint F to a side A0-A1 and to a side A0-A3 of the mounting plane of the carrier in an X-Y plane | 0.046 $\lambda_1$ |
| R1 | Radius of the feed probe | 0.011 $\lambda_1$ |
| R2 | Radius of the active radiation patch that is a fan centered at F | 0.05 $\lambda_1$ |
| R3 | Inner radius of the passive radiation patch that is a quarter of a circle centered at F | 0.074 $\lambda_1$ |
| R4 | Radius of a ground lug that is an arc centered at F | 0.11 $\lambda_1$ |
| R5 | Outer radius of the passive radiation patch that is a quarter of a circle centered at F | 0.1539 $\lambda_1$ |
| Rc | Distance from the feedpoint F to a vertex A0 of a carrier plane in the X-Y plane | 0.071 $\lambda_1$ |
| ρ□ | Degree of an open angle of the ground lug that is an arc centered at F | 15.5 deg |

In addition, F and S in the figure respectively indicate the feedpoint F (Feeding) and a ground point S (Shorting).

Referring to FIG. 17 and Table 6, FIG. 17 is a roundness diagram of the antenna provided in this embodiment, where the antenna is disposed according to the structural parameters in Table 5 and operates at frequencies in Table 6. Table 6 is as follows:

| Frequency GHz | Roundness (Theta = 80 deg) dB |
|---|---|
| 1.7 | 5 |
| 1.9 | 3 |
| 2.1 | 2.2 |
| 2.3 | 2 |
| 2.5 | 2.4 |
| 2.7 | 3 |

In addition, F and S in the figure respectively indicate the feedpoint F (Feeding) and a ground point S (Shorting).

It can be learned from the detailed descriptions in Embodiment 1, Embodiment 2, and Embodiment 3 that, in the antennas provided in the embodiments, a feedpoint position of the antenna element that is disposed on a corner of the carrier is arranged, so that the antenna element located in a vertex position of the carrier has relatively good roundness performance. In addition, when multiple antenna elements are disposed on the carrier, a distance between the antenna elements increases, so as to achieve high isolation between the antenna elements.

The invention claimed is:

1. A device for radio access, the device comprising:

a metal carrier comprising a mounting plane, which comprises a mounting area;

an antenna element disposed in the mounting area and comprising:

a radiation structure connected to a feed structure, wherein the feed structure is fastened to the mounting plane, the radiation structure is a fan shape, and a point at which the feed structure is connected to the mounting plane is a feedpoint;

wherein the mounting area is an area in which the mounting plane intersects a circle centered at the feedpoint of the antenna element in the mounting area and having a radius that does not exceed a specified radius;

wherein the mounting plane is circular or polygonal excluding rectangular; and wherein when a boundary line of the mounting area comprises a boundary line of the mounting plane, a distance from the feedpoint of the antenna element in the mounting area to the boundary line of the mounting area is less than or equal to a specified distance, or when a boundary line of the mounting area comprises a vertex of the mounting plane, a distance from the feedpoint of the antenna element in the mounting area to the vertex is less than or equal to a specified distance.

2. The device according to claim 1, wherein the specified distance is 0.12 $\lambda_l$, the specified radius is 0.25 $\lambda_l$, and $\lambda_l$ is a wavelength corresponding to a minimum operating frequency of the antenna element.

3. The device according to claim 1, wherein a height of the antenna element is not greater than 0.25 $\lambda_l$.

4. The device according to claim 1, wherein the vertex has a structure of a chamfer, and the distance from the feedpoint to the vertex is a distance from the feedpoint to a point at which a connection line between an intersection of extension lines of two boundary lines of the chamfer and the feedpoint intersects the chamfer.

5. The device according to claim 1, wherein the metal carrier is a ground of the antenna element, a metal housing of a wireless device, or a circuit board or heat sink of a wireless device.

6. The device according to claim 1, wherein the feed structure comprises a feed probe.

7. The device according to claim 6, wherein the feed probe comprises:

a column structure; or a conductor sheet whose width gradually increases in a direction from the feedpoint to the radiation structure.

8. The device according to claim 1, wherein the device is a remote radio unit (RRU), base station, radio unit, or an antenna.

9. A device for radio access, the device comprising:

a metal carrier comprising a mounting plane, which comprises a mounting area;

an antenna element disposed in the mounting area and comprising:

a radiation structure connected to a feed structure, wherein the feed structure is fastened to the mounting plane, the feed structure comprises a feed probe, a point at which the feed structure is connected to the mounting plane is a feedpoint, and the feed structure comprises a feed probe having a conductor sheet whose width gradually increases in a direction from the feedpoint to the radiation structure;

wherein the mounting area is an area in which the mounting plane intersects a circle centered at the feedpoint of the antenna element in the mounting area and having a radius that does not exceed a specified radius; and wherein when a boundary line of the mounting area comprises a boundary line of the mounting plane, a distance from the feedpoint of the antenna element in the mounting area to the boundary line of the mounting area is less than or equal to a specified distance, or when a boundary line of the mounting area comprises a vertex of the mounting plane, a distance from the feedpoint of the antenna element in the mounting area to the vertex is less than or equal to a specified distance, wherein the radiation structure comprises at least one radiation patch, wherein the at least one radiation patch comprises a passive radiation patch and an active radiation patch, wherein the active radiation patch is connected to the feed probe, and the passive radiation patch is connected to a ground cable and wherein the radiation structure further comprises a dielectric plate or plastic support, wherein the passive radiation patch and the active radiation patch are disposed on the dielectric plate or plastic support, or the dielectric plate or plastic support, the active radiation patch, and the passive radiation patch are an integrated printed circuit substrate structure, and wherein the dielectric plate or plastic support is a flat plate or a stepped plate, and when the dielectric plate or plastic support is a stepped plate, the passive radiation patch and the active radiation patch are respectively disposed on different step surfaces.

10. The device according to claim 9, wherein the at least one radiation patch comprises one active radiation patch.

11. The device according to claim 9, wherein the active radiation patch and the passive radiation patch are connected by using at least one capacitance or inductance signal.

12. The device according to claim 9, wherein the dielectric plate or plastic support is a flat plate or a stepped plate, and when the dielectric plate or plastic support is a stepped plate, the passive radiation patch and the active radiation patch are respectively disposed on different step surfaces.

13. A device for radio access, the device comprising:

a metal carrier comprising a mounting plane, which comprises a mounting area;

an antenna element disposed in the mounting area and comprising:

a radiation structure connected to a feed structure, wherein the feed structure is fastened to the mounting plane, the radiation structure is a fan shape, and a point at which the feed structure is connected to the mounting plane is a feedpoint;

wherein the mounting area is an area in which the mounting plane intersects a circle centered at the feedpoint of the antenna element in the mounting area and having a radius that does not exceed a specified radius;

wherein the antenna element is placed on an edge of the metal carrier; and wherein when the antenna element is placed on the edge of the metal carrier, a distance from the feedpoint of the antenna element in the mounting area to the edge is less than or equal to a specified distance.

14. The device according to claim 13, wherein when a boundary line of the mounting area comprises a vertex of the mounting plane, a distance from the feedpoint of the antenna element in the mounting area to the vertex is less than or equal to a specified distance.

15. The device according to claim 13, wherein the radiation structure comprises an active radiation patch.

16. The device according to claim 1, wherein the mounting plane is polygonal and when the mounting plane is polygonal, the distance from the feedpoint of the antenna element in the mounting area to the vertex of the polygonal mounting plane is less than or equal to a specified distance, a shortest distance from the feedpoint of the antenna element in the mounting area to the boundary line of the mounting plane is less than or equal to the specified distance, when a vertex of the polygon has a structure of a chamfer, a distance from the feedpoint of the antenna element in the mounting area to the chamfer is less than or equal to the specified distance, or when a vertex of the polygon has an oblique chamfer, a distance from the feedpoint of the antenna element in the mounting area to the oblique chamfer is less than or equal to the specified distance.

17. The device according to claim 1, wherein the mounting plane is circular and when the mounting plane is circular, a distance from the feedpoint of the antenna element in the mounting area to an arc of a boundary line of the circular mounting plane is less than or equal to a specified distance.

18. The device according to claim 13, wherein the specified distance is 0.12 $\lambda_l$, the specified radius is 0.25 $\lambda_l$, and $\lambda_l$ is a wavelength corresponding to a minimum operating frequency of the antenna element, and wherein a height of the antenna element is not greater than 0.25 $\lambda_l$.

19. The device according to claim 13, wherein the radiation structure is a fan shape.

* * * * *